United States Patent [19]

Spence

[11] 4,066,297

[45] Jan. 3, 1978

[54] PROCESS FOR THE RECOVERY OF URANIUM

[75] Inventor: Andrew P. Spence, Plano, Tex.

[73] Assignee: Atlantic Richfield Company, Los Angeles, Calif.

[21] Appl. No.: 691,344

[22] Filed: June 1, 1976

[51] Int. Cl.[2] ..... E21B 43/28
[52] U.S. Cl. ..... 299/4; 423/17
[58] Field of Search ..... 299/4, 5; 423/17

[56] References Cited

U.S. PATENT DOCUMENTS

| | | | |
|---|---|---|---|
| 2,896,930 | 7/1959 | Menke et al. | 299/5 |
| 3,708,206 | 1/1973 | Hard et al. | 299/5 |
| 3,792,903 | 2/1974 | Rhoades | 299/5 |

*Primary Examiner*—Ernest R. Purser
*Attorney, Agent, or Firm*—Ronnie D. Wilson

[57] ABSTRACT

The present invention relates to a process for the solution mining of uranium from a subterranean formation. More specifically, the invention relates to the injection of an alkaline leach solution undersaturated in carbonates into a subterranean formation for the mining of uranium.

7 Claims, 1 Drawing Figure

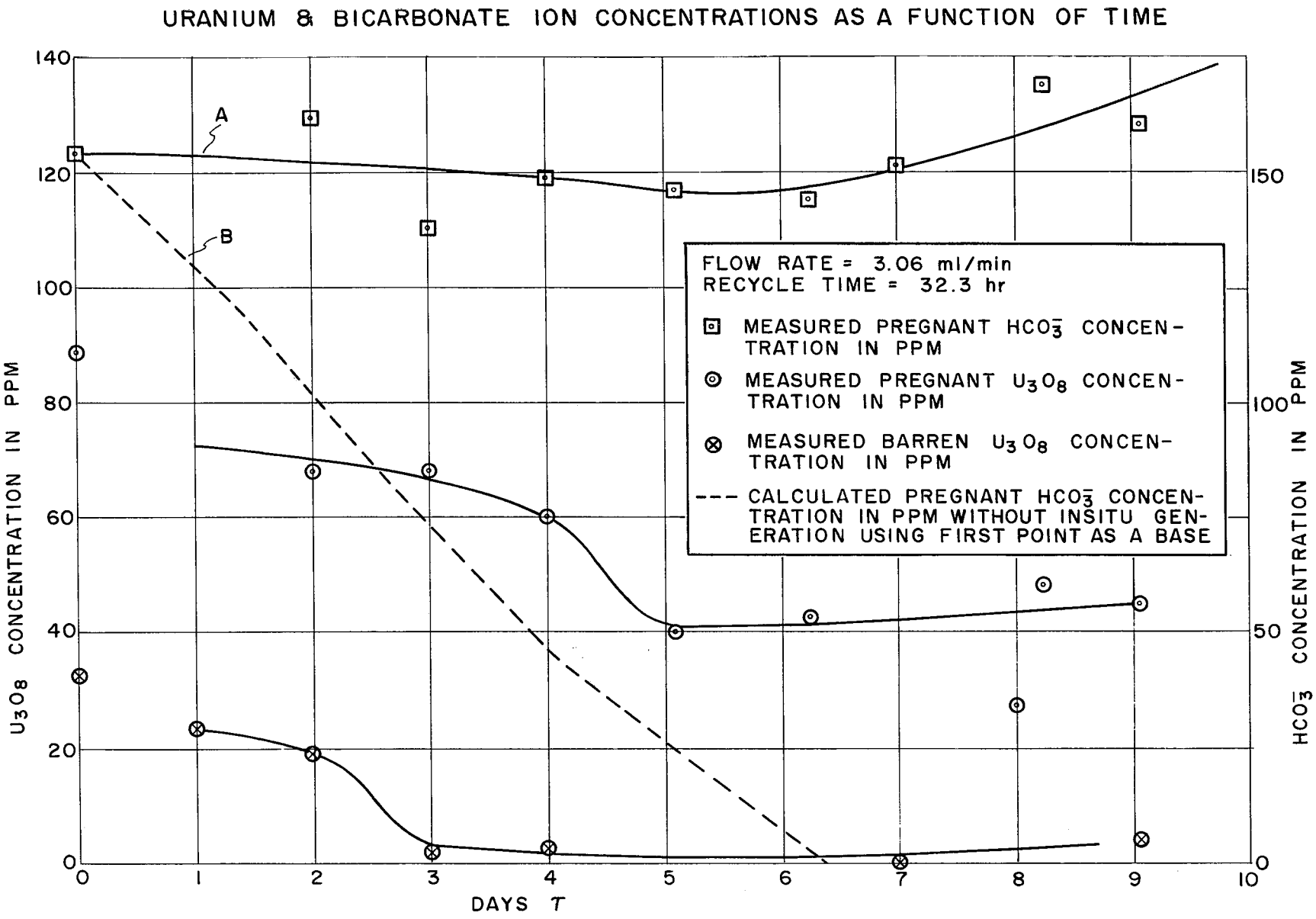
URANIUM & BICARBONATE ION CONCENTRATIONS AS A FUNCTION OF TIME
FLOW RATE = 3.06 ml/min
RECYCLE TIME = 32.3 hr
MEASURED PREGNANT $HCO_3^-$ CONCENTRATION IN PPM
MEASURED PREGNANT $U_3O_8$ CONCENTRATION IN PPM
MEASURED BARREN $U_3O_8$ CONCENTRATION IN PPM
CALCULATED PREGNANT $HCO_3^-$ CONCENTRATION IN PPM WITHOUT INSITU GENERATION USING FIRST POINT AS A BASE
A
B
$U_3O_8$ CONCENTRATION IN PPM
$HCO_3^-$ CONCENTRATION IN PPM
DAYS T
0
20
40
60
80
100
120
140
50
150
1
2
3
4
5
6
7
8
9
10

PROCESS FOR THE RECOVERY OF URANIUM

Generally, known processes for solution mining of uranium in situ utilize an acid or alkaline leach solution for the dissolution of the uranium. An oxidant is injected into the formation along with the leach solution. Uranium is leached from the formation and recovered from a production well via a pregnant leach solution. Various procedures for recovering the uranium from the pregnant leach solution are well known, such as ion exchange.

An inherent problem of solution mining uranium via an acid or alkaline solution is the precipitation of alkaline metal salts from the leach solution causing plugging of formation and wells and decreasing leachability. Alkaline metal ions are by-products of solution mining of uranium with most alkaline leach processes. For example, calcium is the product of the solubilization of calcium carbonate, and sulfate is one of the products of the oxidation of pyrite marcasite and molybdenite.

Although acid leaching solutions can be used in some formations, only alkaline leaching solutions can be used where the particular formation contains significant quantities of acid-consuming gangue.

It has been found that the continued injection of the generally utilized alkaline solutions of ammonium carbonate, sodium carbonate or potassium carbonate and their respective bicarbonates in conjunction with the typical oxidants of air, oxygen, and hydrogen peroxide will result in a build up of alkaline metal ions which will precipitate causing plugging of the formation and/or the wells. The plugging can become so severe that the solution mining patterns or the process utilized must be terminated. Therefore, there is needed a process whereby a uranium containing formation can be leached with an alkaline leach solution without being accompanied by precipitation in the formation and the wells.

Therefore, it is an object of the present invention to provide a process for the solution mining of uranium from subterranean formations.

A further object of the present invention is to provide a process for the solution mining of uranium via alkaline leach solutions.

It is an additional objective of the present invention to provide a process for the solution mining of uranium from subterranean deposits through the injection of an alkaline leach solution undersaturated in carbonates into the deposit to control the in situ environment to prevent the occurrence of precipitation and increase leachability of uranium therefrom.

Other objects, aspects, and the several advantages of the present invention will become apparent upon a further reading of this disclosure and the appended claims.

It has now been found that the objects of the present invention can be attained, in a process for the solution mining of uranium from a subterranean formation containing same in which an injection and production well are drilled and completed within said formation, alkaline leach solution and an oxidant are injected through the injection well into the formation to dissolve the uranium and recover it via a production well, by injecting an alkaline leach solution undersaturated in carbonates into the formation.

In the operation of the improved process, the leach solution is made undersaturated in carbonates by the removal of the cations from the leach solution, thereby promoting the generation of bicarbonate in situ. To remove the undesired ions, an ion exchange unit may be employed or some other technique for removing cations from an aqueous system. Another suitable technique for removing the cations is the utilization of a bleed stream to remove some recycled high cation leach solution out of the system prior to injecting leach solution into the formation.

It is important that the ore body in which the present invention is utilized contain some source of carbonate or bicarbonate. Further, the deposit should contain some source of hydrogen ion not necessarily restricted to the oxidation and/or dissolution of a mineral. If the ore body lacks such a source, the hydrogen ion may be added via injection, for example of $CO_2$ or hydrochloric acid. The discussion herein is in respect to sulfide minerals, but these minerals were utilized as examples only and the present invention is not limited thereto.

Some of the known alkaline leach processes call for the oxidation of the uranium from the plus 4 to the plus 6 valence state followed by the dissolution of the uranium as the uranyl tricarbonate and/or dicarbonate anion. To provide the bicarbonate ion for the uranyl tricarbonate and/or dicarbonate anion dissolution, some type of chemical addition is used. This chemical addition is via the leach solution which generally contains ammonium carbonate, sodium carbonate or potassium carbonate and their respective bicarbonates. Typical oxidants used in conjunction with the chemical addition are air, oxygen and hydrogen peroxide.

It has been found that the chemical addition causes the precipitation of alkaline earth metal salts, the particular type depends on the ore body being mined, because of the supersaturation of the leach solution with the alkaline earth metal ions which are present in the ore body.

It is believed that an increase in leach solution pH and/or the addition of chemicals, for example ammonium carbonate or bicarbonate, makes calcium carbonate less soluble through the $H_2CO_3$, $HCO_3^-$, $CO_3^=$ equilibrium defined by the following equations.

$$H_20 + CO_2 \rightleftarrows H_2CO_3$$

$$H_2CO_3 \rightleftarrows H^+ + HCO_3^-$$

$$HCO_3^- \rightleftarrows H^+ + CO_3^{32}$$

The net effect is that calcium carbonate precipitates, lowering the solution pH and bicarbonate ion concentration.

During the oxidation of uranium, minerals such as sulfides are also oxidized. The oxidation of these sulfide compounds generates hydrogen ion. For example, the oxidation of molybdenite or jordisite ($MoS_2$) and pyrite or marcasite ($FeS_2$) follows the stoichiometric equations:

$$FeS_2 + 15/4O_2 + 7/2H_2O \rightarrow Fe(OH)_3 + 2SO_4^= + 4H^+$$

$$MoS_2 + 9/2\ O_2 + 3H_2O \rightarrow MoO_4^= + 2SO_4^= + 6H^+$$

If the leach solution is undersaturated in carbonates, the hydrogen ion will react with the carbonates present in the ore body to form bicarbonate ion. Using calcium and magnesium as examples, the stoichiometric equations are:

$$CaCO_3 + H^+ \rightarrow Ca^{++} + HCO_3^-$$

$$MgCO_3 + H^+ \rightarrow Mg^{++} + HCO_3^-$$

Thus, by removing alkaline earth metal ions from the leach solution prior to injection into the formation, the leach solution is made undersaturated in carbonates promoting the in situ bicarbonate generation. As a control to determine the quantity of ions to remove from the leach solution, either the bicarbonate ion concentration or the formation pH can be utilized.

The amount of alkaline earth metal ions to remove from the leach solution is determined by the particular ore body in which the present invention is being utilized. As an example, if calcium were the ion needed to be removed, the determination could be made along the following lines considering the bicarbonate ion concentration as the control point. In order to hold the bicarbonate ion concentration constant, the rate of calcium carbonate solubilization (generating bicarbonate ion) should be balanced against the rate of uranium dissolution (consuming bicarbonate ion). The latter reaction follows the following set of stoichiometric equations:

$$UO_2^{+2} + 4HCO_3^- \rightarrow UO_2(CO_3)_3^{-4} + 2H_2O + CO_2$$

$$CO_2 + H_2O \rightleftarrows H_2CO_3 \rightleftarrows H^+ + HCO_3^- \rightleftarrows 2H^+ + CO_3^=$$

The above equations illustrate that the uranium solubilization consumes three moles of bicarbonate ion per mole of uranium solubilized while one mole of calcium ion removed generates one mole of bicarbonate ion.

Therefore to generate enough bicarbonate ion to meet a production rate of 25 to 35 ppm $U_3O_8$ for the produced solution, 10.7 to 15 mg/liter of calcium ion must be removed from the injection solution. This is approximately equivalent to 800 to 1120 pounds of $CaCO_3$ per day (320 to 450 pounds of $Ca^{++}$ per day) at 2500 gpm.

In order for the ore body to provide the necessary hydrogen ion for in situ bicarbonate generation, the oxidation of the sulfide minerals must proceed at a rate sufficient to generate from 5.7 to 12.0 ppm $SO_4^=$ per pass of leach solution through the ore body depending on whether the molybdenum or iron sulfide is the mineral being oxidized and whether the pregnant solution contains 25 or 35 ppm $U_3O_8$.

The following comparative example is shown to illustrate the effective operation of the improved process described herein. A comparison between the use of ion removal and no ion removal is shown.

EXAMPLE

A 3 inch diameter × 112 inch core containing 16,712 gm of unconsolidated reduced uranium ore was leached for 11 days using an ammonium bicarbonate solution circulating in a closed loop system. The pregnant (uranium enriched) leach solution produced from the core at the rate of approximately 3 ml/min was processed in an ion exchange column (Amberlite IRA-430 resin in the chloride form) to recover the dissolved uranium, after filtration with activated carbon to remove any suspended solids. A slip stream of the barren leach solution from the ion exchange column was further processed in a water softening column (Amberlite DP-1 resin in the sodium form) to remove magnesium and calcium in order to make the leach solution undersaturated in calcium carbonate. The slip stream was recombined with the barren leach solution and had oxygen dissolved in it to 75–85% saturation at 48 psig. Subsequently, oxygenated barren leach solution was injected into the core.

No carbonate or bicarbonate ion was added to the leach solution during the core leach. Other than that present in the core itself, the only bicarbonate ion present in the system was that present in the initial charge of leach solution used to fill the core. Leach solution lost from the system through sampling was replaced with deionized water. The core leach illustrated that the majority of the uranium recovered was via bicarbonate ion provided by the ore and not the leach solution. A total of 8.01 gm of uranium ($U_3O_8$) was recovered during the core leach. The recovery process consumed 5.22 gm of bicarbonate. An additional 0.16 gm of bicarbonate was lost through samling of solution. The 5540 ml of leach solution used contained 500 ppm $HCO_3^-$ at the start and 164 ppm $HCO_3^-$ at the end with no external additionals of bicarbonate ion during the core leach. Therefore, only 1.85 gm of bicarbonate ion was provided by the leach solution, 34.4% of that used in the core leach. The amount of bicarbonate ion generated in situ was actually higher than indicated by the above analysis because the amount of bicarbonate ion lost through ion exchange column replacement was ignored. Bicarbonate ion provided by the moisture content of the core was only about 0.05 gm ($HCO_3^-$).

The uranium production data and pregnant solution bicarbonate ion concentration data for the eleven (11) day core leach emphasizes the dependence of the leach on in situ bicarbonate generation which results from the leach solution being undersaturated in carbonates. A plot of this data is shown in the graph. Curve A is the measured bicarbonate ion concentration. Dashed curve B was determined by using the value measured at 8:00 a.m. on day 0 as the base and reducing it by the amount of bicarbonate ion consumed in the uranium dissolution reaction. Dashed curve B shows that the bicarbonate ion concentration quickly goes to zero without any replacement thereof.

I claim:

1. An improved process for the solution mining of uranium from a subterranean formation containing same in which an injection and production well are drilled and completed within said formation, alkaline leach solution and an oxidant are injected through said injection well into said formation to dissolve said uranium, and said dissolved uranium is recovered via said production well, wherein the improvement comprises introducing an alkaline leach solution undersaturated in carbonates into said formation.

2. The improvement of claim 1 wherein said alkaline leach solution is an aqueous solution of one or more salts selected from the group consisting of ammonium carbonate, sodium carbonate, potassium carbonate and their respective bicarbonates.

3. The improvement of claim 1 wherein said oxidant is selected from the group consisting of air, oxygen and hydrogen peroxide.

4. The improvment of claim 1 wherein said alkaline leach solution is made undersaturated in carbonates by the removal of alkaline metal ions present in said alkaline leach solution.

5. The improvement of claim 4 wherein said alkaline metal ions are removed via a water softening unit.

6. The improvement of claim 4 wherein said alkaline metal ions are removed via bleeding a portion of the recycled alkaline leach solution.

7. The improvement of claim 4 wherein said alkaline metal ions are selected from the group consisting of calcium, magnesium, potassium, and sodium.

* * * * *